United States Patent [19]

Stahl

[11] 3,987,602

[45] Oct. 26, 1976

[54] METHOD AND APPARATUS FOR PACKAGING SMELTABLE OR FLUID MATERIAL

[76] Inventor: Margarete Stahl, Rheinweg 105, D-53 Bonn, Germany

[22] Filed: Mar. 21, 1975

[21] Appl. No.: 560,746

[30] Foreign Application Priority Data

Mar. 21, 1974 Germany ..... 2413575

[52] U.S. Cl. ..... 53/25; 53/28; 53/127; 53/180 M; 53/385

[51] Int. Cl.[2] ..... B65B 1/02; B65B 1/06; B65B 43/36

[58] Field of Search ..... 53/25, 28, 79, 127, 53/180 M, 385, 29, 37, 39

[56] References Cited

UNITED STATES PATENTS

| | | | |
|---|---|---|---|
| 2,861,406 | 11/1958 | Holsman et al. | 53/385 X |
| 3,298,156 | 1/1967 | Lerner | 53/385 X |
| 3,469,363 | 9/1969 | Berckmoes | 53/25 |
| 3,542,570 | 11/1970 | Bush et al. | 53/25 X |

*Primary Examiner*—Travis S. McGehee
*Assistant Examiner*—Horace M. Culver
*Attorney, Agent, or Firm*—Pollock, Vande Sande & Priddy

[57] ABSTRACT

An automatic, fully continuous process and apparatus for packaging smeltable or fluid material in flexible synthetic foil containers. The foil is folded into tubular shape, fused along its longitudinal seam, sealed at its leading end and fed into a cooling bath. The material to be packaged is then introduced far below the surface of the cooling bath through the still open trailing end of the tubing, a portion of which is thereafter sealed. The same process is repeated with succeeding tube portions, which are fed seriatim through the cooling bath and, if desired, through a second cooling bath, by means of conveyor belts. At the end of the process, the individual packages are severed from one another for subsequent transport.

8 Claims, 4 Drawing Figures

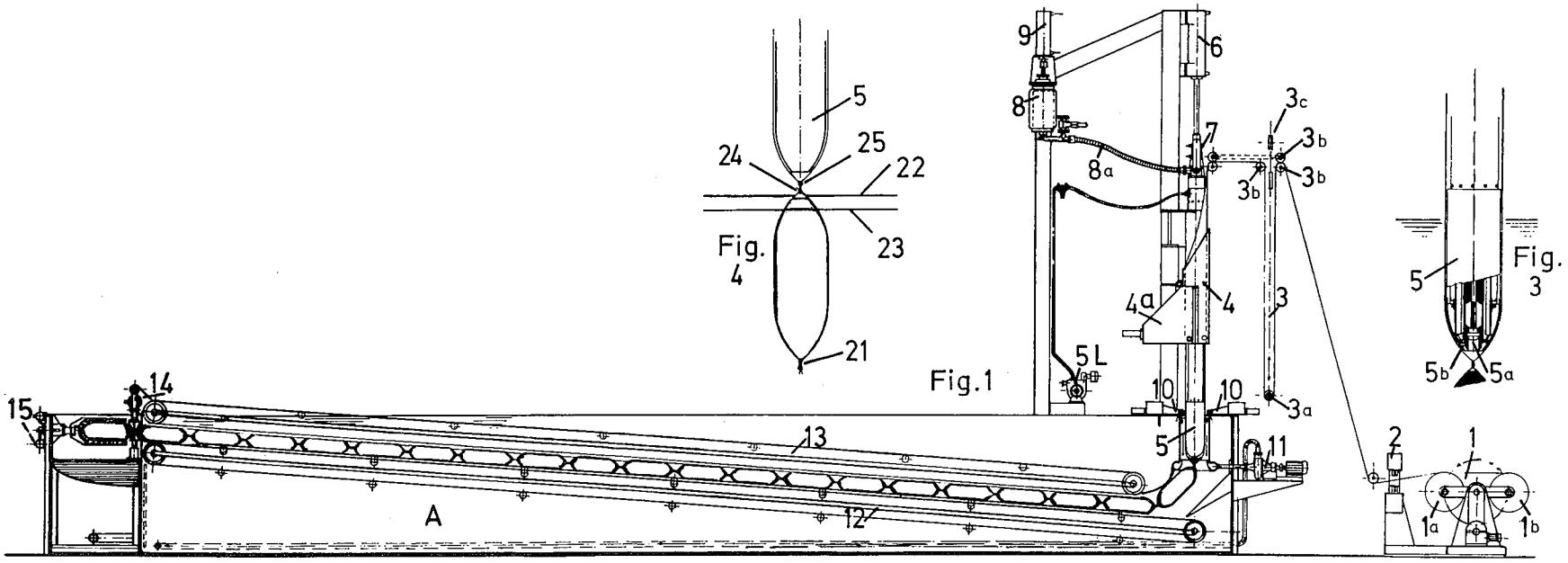
Fig. 3
Fig. 1
Fig. 4
A
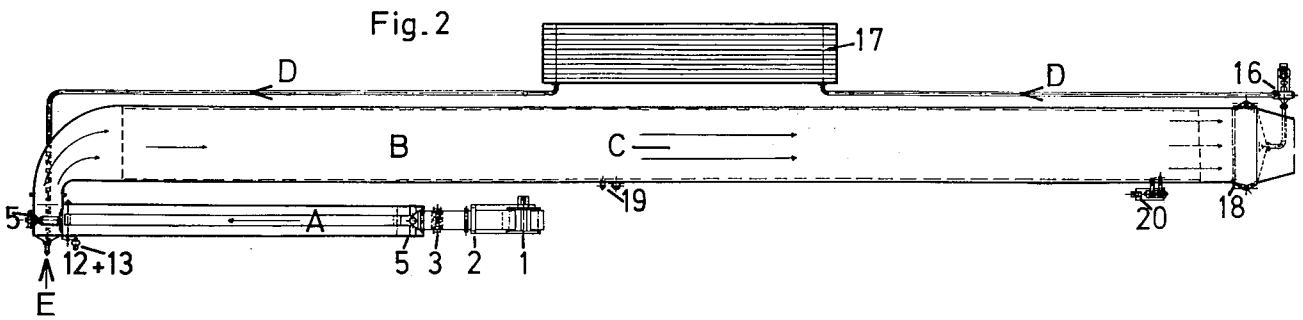
Fig. 2
A
B
C
D
E

METHOD AND APPARATUS FOR PACKAGING SMELTABLE OR FLUID MATERIAL

The invention relates to a method and apparatus for packaging smeltable or fluid material, especially molten bitumen, in flexible synthetic foil containers resistant to water and to the molten material, by pouring in the material in its fluid state and, in the case of materials which are solid at room temperature, allowing hardening after the container is sealed, the containers being cooled during the filling stage by a water bath.

In a known process, the containers are fixed above the water bath prior to the start of filling, and are progressively lowered into the bath as filling progresses, while the surface of the molten material remains at approximately the same height as the water surface. This process is cumbersome, since it necessitates first attaching a previously prepared bag, open at the top, to a support, then introducing the filler material through the open end, removing the bag from the support, closing it above the water surface, and then cooling it in a water bath. The process by its very nature is a discontinuous one, and has the further disadvantage that a fusing foil packing cannot be used i.e., that the user is required to remove the packing foil before processing the packaged material, e.g., in the case of bitumen, to smelt such material.

The object of the invention is to provide for a simplified packaging method permitting more rapid operation and hence augmented production. Furthermore, the invention permits the use in every instance, i.e., in the case of both hard and soft bitumins, of fusing foil, thus obviating the need for removing the packaging foil. According to the invention, this object is attained by using synthetic foil in the automatically operating packaging apparatus, the foil being folded into tubular shape and fused along the longitudinal seam, whereupon the tube is sealed at the end which is at the front in the direction of movement, the fusible or fluid material is then introduced into a water bath far below the surface thereof by way of the still open back end of the tube, the tube is closed to make it into a container, and finally a further tube portion having an opening at the top is formed, filled, and sealed, and the sack band is continuously led through the water bath, and, if appropriate, to an adjoining cooling bath.

The principal advantages of the novel process are the following:

1. The method is automatic and fully continuous, so that the performance of the installation is markedly increased, and considerable savings in personnel are made possible. 2. In every case fusing foil can be used, since the introduction of high temperature material occurs totally under water, and hence there is no danger that the foil will melt. 1. Even soft, i.e., easily fusible foil can be used, this being particularly important in packaging, e.g., bitumins having a low melting point.

An apparatus suitable for carrying out the process according to the invention is shown in the accompanying drawing, wherein:

FIG. 1 shows a vertical section through the filling apparatus;

FIG. 2 shows a plan view of such apparatus;

FIG. 3 shows a vertical partial section through a plunger suitable for introducing the material, and FIG. 4 shows the manner of closing the containers.

FIG. 1 shows a foil roll arrangement, consisting in the present embodiment of two foil rolls 1*a* and 1*b*. When foil roll 1*a* is empty, a continuous, unending connection with the foil on roll 1*b* can be made by means of a pulse welding station 2. The band then reaches compensating attachment 3, whose purpose is to effectuate an even feed at the moment of fusing the ends of the foils from rolls 1*a* and 1*b*, which requires a short pause. This compensation is achieved by means of equalizer roller 3*a*, which permits the foil guided over guide roll 3*b* to feed at constant speed, due to the fact that it moves up- and downwardly with the aid of balancing sheave 3*c*, in accordance with the length of the pause. The foil next passes along a hydraulic cylinder 6 which actuates plunger 5 whose significance will be explained hereinbelow. It then reaches a tube forming means 4, in which the foil is folded into tubular shape. The longitudinal seam is formed with the aid of pulse welder 4*a*, so that a tubular foil is produced. Two welding means 10 then seal this foil by means of a double mash seam weld producing the seal closing the bottom of the tube, and shown in FIG. 4 by numeral 21.

The sealed tube, is next fed down into cooling basin A, until it reaches the position also shown in FIG. 4, wherein 22 designates the water level. In the position here shown the tube, still open at the top, is filled by way of the plunger 5 which is arranged inside the tube forming means 4. The design of plunger 5 can be seen in FIG. 3, and includes a bitumen valve 5*a* and, an air outlet 5*b*. Air is forced by blower 5L (see FIG. 1) into plunger 5, and passes through air outlet 5*b* into the foil tube, in order to counterbalance the predominating water pressure and thus to prevent collapse of the foil tube through such water pressure. Simultaneously valve 5*a* opens by action of hydraulic cylinder 6, which actuates plunger 5 for up-and-down movement. When plunger 5 is moved away from the sealed lower end of the tubular container by action of hydraulic cylinder 6, a predetermined amount of material is introduced into the still open end of the container by means of dosage means 8, 9. The filler material is conveyed to plunger 5 by way of tube 8*a*, and from plunger 5 (as noted above) into the container, which is filled below the water level, to about level 23. At this point, the pulse welding means 10 go into operation to seal the filled container, which is completely immersed in the water bath, by means of a double mash seam weld 24. The pulse welding means 10 simultaneously forms a further double mash seam weld 25, so that the next container, which is still open at the top, is ready for filling in a continuous mode of operation.

The process just described is repeated continuously, so that the operation is fully automatic. The filled containers are now moved through cooling basin A, and suction pump 11 facilitates the feeding of the container binding in the area of plunger 5, and simultaneously the circulation of cooling water. Conveyor belts 12 and 13, which effect movement of the container chain in synchronism with the feeding through plunger 5, move inside cooling basin A. Where the filler material is, e.g., hot bitumen, oil or the like, conveyor belt 13 simultaneously serves to prevent surfacing of such material, which often has a lower specific weight than water.

The container chain finally reaches collecting trough 15, and is separated into separate containers by cutting means 14.

FIG. 2 illustrates cooling basin B, which is considerably longer than cooling basin A. For example, the length of cooling basin B may be 50 meters, and that of cooling basin A 20 meters. Cooling basin B serves for the further cooling and storage of the filled containers, which are moved in cooling basin B in the direction of arrows C by a water current produced by circulating pump 16, which pumps the water in the direction of arrows D by way of a recooling or refrigerating arrangement 17, and leads it back to cooling basin B at E. The cooled containers, now ready for shipment, are raised out of the water by means of lifting device 18. Finally, 19 indicates a water level control unit, which acts on pumping station 20, whereby water can be added to cooling basin B from a reservoir beneath, or led back to such reservoir depending on the volume of the containers situated in cooling basin B. In this manner, the water level in both cooling basins A and B remains constant, and the water consumption is limited to natural evaporation.

I claim:

1. A method for packaging smeltable or fluid material in flexible synthetic foil containers resistant to water and to the material to be packaged, including the steps of:

a. forming flexible foil into tubular shape;
b. sealing the tubular shape by a longitudinal seam;
c. closing the leading end of the tube so formed;
d. immersing in a cooling bath substantially all of a first portion of the tube to be filled with the smeltable or fluid material;
e. filling the tube with air under pressure;
f. introducing the smeltable or fluid material while in its fluid state into the said first portion, the material after its introduction being situated below the surface of the cooling bath;
g. closing the trailing end of the said first portion of the tube and the leading end of the next portion of the tube to be filled; and
h. continuously feeding the chain of successive filled portions of the tube through the cooling bath.

2. The method according to claim 1, including the further step of feeding the chain of successive filled portions of the tube through a second cooling bath.

3. The method according to claim 1, including the step of severing the filled portions of the tube from one another to form individual filled containers.

4. Apparatus for packaging smeltable or fluid material in flexible synthetic foil containers resistant to water and to the material to be packaged, comprising a. two foil rolls from which foil is fed to a pulse welding station for continuously welding the foil to form an endless web;
b. a tube forming means for folding the foil into tubular shape;
c. a pulse welder for securing the tube by a longitudinal seam;
d. two welding means for sealing the bottom of the tube by a double pinched seam to form a container open at the top;
e. a cooling bath;
f. means for feeding the tube into said cooling bath;
g. a plunger located within the tube forming means for filling the container in predetermined doses through its open top, in such manner that the filler material is situated below the surface of the cooling bath said plunger having means for inflating the tube with air under pressure;
h. the welding means sealing the top of the container while the material is fully immersed in the water and simultaneously forming a double mash seam weld in the next tubular section, which is still open at the top;
i. means for feeding the chain of filled containers one by one through the cooling bath; and
j. cutting means for separating the containers.

5. Apparatus according to claim 4, further comprising a second cooling bath substantially longer than the first cooling bath, for cooling the chain of containers, means for moving the containers through the second cooling bath by a water current, and means for lifting the containers out of the second cooling bath.

6. Apparatus according to claim 4, wherein the plunger has a bitumen valve and an air outlet.

7. Apparatus according to claim 4, including an equalizer roller adapted for up-and-down movement with the aid of a balancing sheave in correspondence with the length of the pause required for fusing the ends of the foils being fed from the foil rolls.

8. Apparatus according to claim 4, including conveyor belts arranged inside the cooling bath, for effecting movement of the container chain in synchronism with the movement of the plunger.

* * * * *